US008223076B2

(12) United States Patent
Huang

(10) Patent No.: US 8,223,076 B2
(45) Date of Patent: Jul. 17, 2012

(54) MINIFIED DUAL-BAND PRINTED MONOPOLE ANTENNA

(75) Inventor: Chih-Yung Huang, Taichung County (TW)

(73) Assignee: Arcady An Technology Corporation, Hsinchu (TW)

( * ) Notice: Subject to any disclaimer, the term of this patent is extended or adjusted under 35 U.S.C. 154(b) by 371 days.

(21) Appl. No.: 12/645,785

(22) Filed: Dec. 23, 2009

(65) Prior Publication Data

US 2010/0164828 A1 Jul. 1, 2010

(30) Foreign Application Priority Data

Dec. 30, 2008 (TW) ..... 97151420 A

(51) Int. Cl.
*H01Q 1/38* (2006.01)

(52) U.S. Cl. ..... 343/700 MS; 343/852; 343/860

(58) Field of Classification Search ..... 343/700 MS, 343/702, 850, 852, 860, 862
See application file for complete search history.

(56) References Cited

U.S. PATENT DOCUMENTS

| | | | | |
|---|---|---|---|---|
| 7,505,001 | B2 * | 3/2009 | Deavours et al. | 343/700 MS |
| 8,094,076 | B2 * | 1/2012 | Zhang et al. | 343/700 MS |
| 2005/0156787 | A1 * | 7/2005 | Myoung et al. | 343/700 MS |
| 2010/0127941 | A1 * | 5/2010 | Chiang et al. | 343/700 MS |

* cited by examiner

*Primary Examiner* — Tan Ho
(74) *Attorney, Agent, or Firm* — WPAT, P.C.; Justin King

(57) ABSTRACT

A dual-band printed monopole antenna is disclosed. The antenna is in a rectangular structure and comprising: a first radiating unit; a second radiating unit; a matching unit; a first matching unit; a second matching unit; a signal feed-in terminal, and a feed-in signal grounding terminal, whereby its size is effectively minified so as to meet the demand for the application of the minified modern wireless apparatus.

29 Claims, 18 Drawing Sheets

| Setup | Band | 11b/g | | | 11a | | | | | | | | |
|---|---|---|---|---|---|---|---|---|---|---|---|---|---|
| | Frequency(GHz) | 2.40GHz | 2.45GHz | 2.50GHz | 2.90GHz | 5.15GHz | 5.25GHz | 5.35GHz | 5.470GHz | 5.725GHz | 5.825GHz | 5.850GHz | 5.875GHz |
| Y-Z Plane | Peak. Gain. (dBi) | 1.66 | 1.62 | 2.42 | 4.78 | 3.74 | 4.42 | 3.79 | 4.22 | 4.28 | 4.66 | 5.37 | 5.50 |
| | Avg. Gain. (dBi) | -0.91 | -0.92 | -0.25 | 0.24 | -0.16 | 0.96 | 0.53 | 1.21 | 1.27 | 1.82 | 2.55 | 2.71 |
| X-Y Plane | Peak. Gain. (dBi) | -0.91 | 0.45 | 1.81 | 2.24 | 2.34 | 2.85 | 1.93 | 2.21 | 0.54 | 1.06 | 1.93 | 2.27 |
| | Avg. Gain. (dBi) | -2.52 | -2.83 | -1.95 | -2.75 | -3.15 | -2.51 | -3.04 | -2.84 | -3.09 | -2.55 | -1.81 | -1.74 |
| Z-X Plane | Peak. Gain. (dBi) | -1.47 | -2.32 | -1.70 | 0.66 | 0.90 | 1.88 | 1.38 | 1.74 | 2.52 | 3.35 | 4.24 | 4.41 |
| | Avg. Gain. (dBi) | -2.64 | -3.15 | -2.64 | -2.89 | -3.17 | -2.32 | -2.82 | -2.10 | -1.20 | -0.32 | 0.56 | 0.83 |

FIG. 4

MINIFIED DUAL-BAND PRINTED MONOPOLE ANTENNA

BACKGROUND OF THE INVENTION

1. Field of the Invention

The present invention relates to a dual-band printed monopole antenna, more particularly, to the antenna with minified size.

2. Description of the Prior Arts

In the modern age of daily advanced technologies, various minified antennas are developed so as to serve the application of different daily-minified hand-held devices such as cellular phones, notebook, or wireless communication apparatus (such as AP). For example, the planar Inverse-F Antenna (PIFA) characterized in simple but easy structure, good transmission, and easily-installed for the inner side of the hand-held devices is a good example to be broadly applied in various hand-held electronic devices such as wireless transmission apparatus, notebook computers, and wireless communication apparatus. However, the conventional PIFA is rather large in term of its size and suffers from its space occupation, thus hard to meet the demand for further minifying.

Accordingly, in view of the above drawbacks, it is an imperative that a dual-band printed monopole antenna is designed so as to solve the drawbacks as the foregoing and applicable to the minified wireless electronic apparatuses.

SUMMARY OF THE INVENTION

In view of the disadvantages of prior art, the primary object of the present invention relates to a dual-band printed monopoly antenna for addressing the issue of conventional antennas suffering from large size and space consuming.

According to one aspect of the present invention, a dual-band printed monopole antenna, printed on the first face of a substrate in a rectangular structure, wherein said rectangular structure's peripheral consisting of a first edge, a second edge, a third edge and a fourth edge, said antenna comprises: a first radiating unit, being of a strip structure and disposed at the inner side of the peripheral, and said strip structure extending to the third edge from the first edge and along the second edge, and said third edge further bending toward the direction of the first edge; a second radiating unit, being of the strip structure and disposed at the inner side of the peripheral, and said strip structure extending to the third edge from the first edge and along the fourth edge; a matching unit, being disposed between the first radiating unit and the second radiating unit, for enabling the first radiating unit and the second radiating unit electronically connected; a signal feed-in terminal, electronically connected with said second radiating unit; and a feed-in signal grounding terminal, adjacently disposed at the first face of the substrate with said signal feed-in terminal.

Preferably, said first radiating unit, said second radiating unit, said matching unit, said first matching unit, said second matching unit, and said signal feed-in terminal in the present invention are of building-integrated metal structure.

Preferably, said matching unit in the present invention further comprises a cavity, and its size is changed so as to adjust the antenna impedance matching of said first radiating unit and said second radiating unit.

Preferably, said cavity's shape is "L" shaped.

Preferably, the antenna disclosed in the present invention further comprises a first matching unit, disposed at said first radiating unit, and taken shaped at the exterior side of said rectangular structure.

Preferably, said first radiating unit and said first matching unit disclosed in the present invention are of building-integrated metal structure.

Preferably, the antenna disclosed in the present invention further comprises a second matching unit, disposed at said second radiating unit, and taken shaped at the interior side of said rectangular structure.

Preferably, said second radiating unit and said second matching unit disclosed in the present invention are of building-integrated metal structure.

Preferably, the first matching unit or the second matching unit is in the shape of quadrilateral or rectangular.

Preferably, the antenna further comprises a feed-in wire coupled to said signal feed-in terminal.

Preferably, the length of the first radiating unit is equivalent to one-fourth co-vibrating wavelength of its operating frequency.

Preferably, the length of the second radiating unit is equivalent to one-fourth co-vibrating wavelength of its operating frequency.

Preferably, the first radiating unit is operating in a first operating frequency, and the second radiating unit is operating in a second operating frequency, and said first operating frequency is smaller than the second operating frequency.

Preferably, the first operating frequency is suitable for IEEE 802.11b/g/n (2.4 G~2.5 GHz) and the second operating frequency is suitable for IEEE 802.11a (4.9 GHz~5.85 GHz).

Preferably, said feed-in signal grounding terminal further comprises a first feed-in signal grounding terminal and a second grounding terminal, wherein said first feed-in signal grounding terminal and said second grounding terminal are taken shaped at the first face of the substrate and make the signal feed-in terminal being disposed between said first feed-in signal grounding terminal and the second grounding terminal.

Preferably, said feed-in signal grounding terminal further comprises a first feed-in signal grounding terminal and a third grounding terminal, wherein said first feed-in signal grounding terminal and said signal feed-in terminal are adjacently disposed at the first face of said substrate, and said third grounding terminal is taken shaped at the second face of said substrate, and said third grounding terminal is taken shaped at the location of the second face of the substrate is complimentary to said first feed-in signal grounding terminal.

Preferably, said feed-in signal grounding terminal and said third grounding terminal are disposed at the second face of the substrate complimentary to said first feed-in signal grounding terminal and said second grounding terminal.

Preferably, said feed-in signal grounding terminal in the present invention further comprises a first feed-in signal grounding terminal, a second grounding terminal and a third grounding terminal, wherein said first feed-in signal grounding terminal and said second grounding terminal are taken shaped at the first face of the substrate and make the signal feed-in terminal being disposed between said first feed-in signal grounding terminal and the second grounding terminal, and said third grounding terminal is taken shaped at a second face of the substrate.

Preferably, said feed-in signal grounding terminal and said third grounding terminal is taken shaped at the location of the second face of the substrate and is complimentary to said first feed-in signal grounding terminal and said second grounding terminal.

Preferably, said dual-band printed monopole antenna in the present invention is disposed at one of the corners of the substrate.

According to another aspect of the present invention, a dual-band printed monopole antenna, printed on the first face of a substrate in a rectangular structure, wherein said rectangular structure's peripheral consisting of a first edge, a second edge, a third edge and a fourth edge, said antenna comprises: a first radiating unit, being of a strip structure and disposed at the inner side of the peripheral, and said strip structure extending to the third edge from the first edge and along the second edge, and said third edge further bending toward the direction of the first edge; a second radiating unit, being of the strip structure and disposed at the inner side of the peripheral, and said strip structure extending to the third edge from the first edge and along the fourth edge; a matching unit, being disposed between the first radiating unit and the second radiating unit, for enabling the first radiating unit and the second radiating unit electronically connected; a first matching unit, being disposed at the first radiating unit, and taken shaped at the exterior side of the peripheral of said rectangular structure; a second matching unit, being disposed at the first radiating unit, and taken shaped at the inner side of the peripheral of said rectangular structure; a signal feed-in terminal, electronically connected with said second radiating unit; and a feed-in signal grounding terminal, comprising a first feed-in signal grounding terminal, a second grounding terminal, and a third grounding terminal, wherein said first feed-in signal grounding terminal and said second grounding terminal are taken shaped at the first face of the substrate and make the signal feed-in terminal being disposed between said first feed-in signal grounding terminal and the second grounding terminal, and said third grounding terminal is taken shaped at a second face of the substrate.

Preferably, said first radiating unit, said second radiating unit, said matching unit, said first matching unit, said second matching unit, and said signal feed-in terminal in the present invention are of building-integrated metal structure.

Preferably, said matching unit further comprises a cavity, and its size is changed so as to adjust the antenna impedance matching of said first radiating unit and said second radiating unit.

Preferably, said cavity's shape is "L" shaped

Preferably, said first matching unit or said second matching unit is in the shape of quadrilateral or rectangular.

Preferably, the antenna disclosed in the present invention further comprises a feed-in wire coupled to said signal feed-in terminal.

Preferably, the length of the first radiating unit is equivalent to one-fourth co-vibrating wavelength of its operating frequency.

Preferably, the length of the second radiating unit is equivalent to one-fourth co-vibrating wavelength of its operating frequency.

Preferably, said third grounding terminal is disposed at the second face of the substrate complimentary to said first feed-in signal grounding terminal and said second grounding terminal.

Preferably, said dual-band printed monopole antenna in the present invention is disposed at one of the corners of the substrate.

Preferably, said dual-band printed monopole antenna is disposed at the substrate in pair, wherein said first radiating unit, said second radiating unit, said matching unit, said first matching unit, said second matching unit, said signal feed-in terminal and said first feed-in signal grounding terminal are complimentary disposed, said second grounding terminal and said third grounding terminal are commonly-shared disposed.

Preferably, said pair of dual-band printed monopole antennas are disposed at the two complimentary corners of the substrate Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become readily understood from the detailed description given herein below and the accompanying drawings which are given by way of illustration only, and thus are not limitative of the present invention and wherein:

FIG. 1I relates to an antenna field plot measured at the Y-Z plane based upon the description of FIG. 1A;

FIG. 4 relates to a table for frequencies vs. gains at different planes.

DESCRIPTION OF THE EXEMPLARY EMBODIMENTS

Figure 1A:
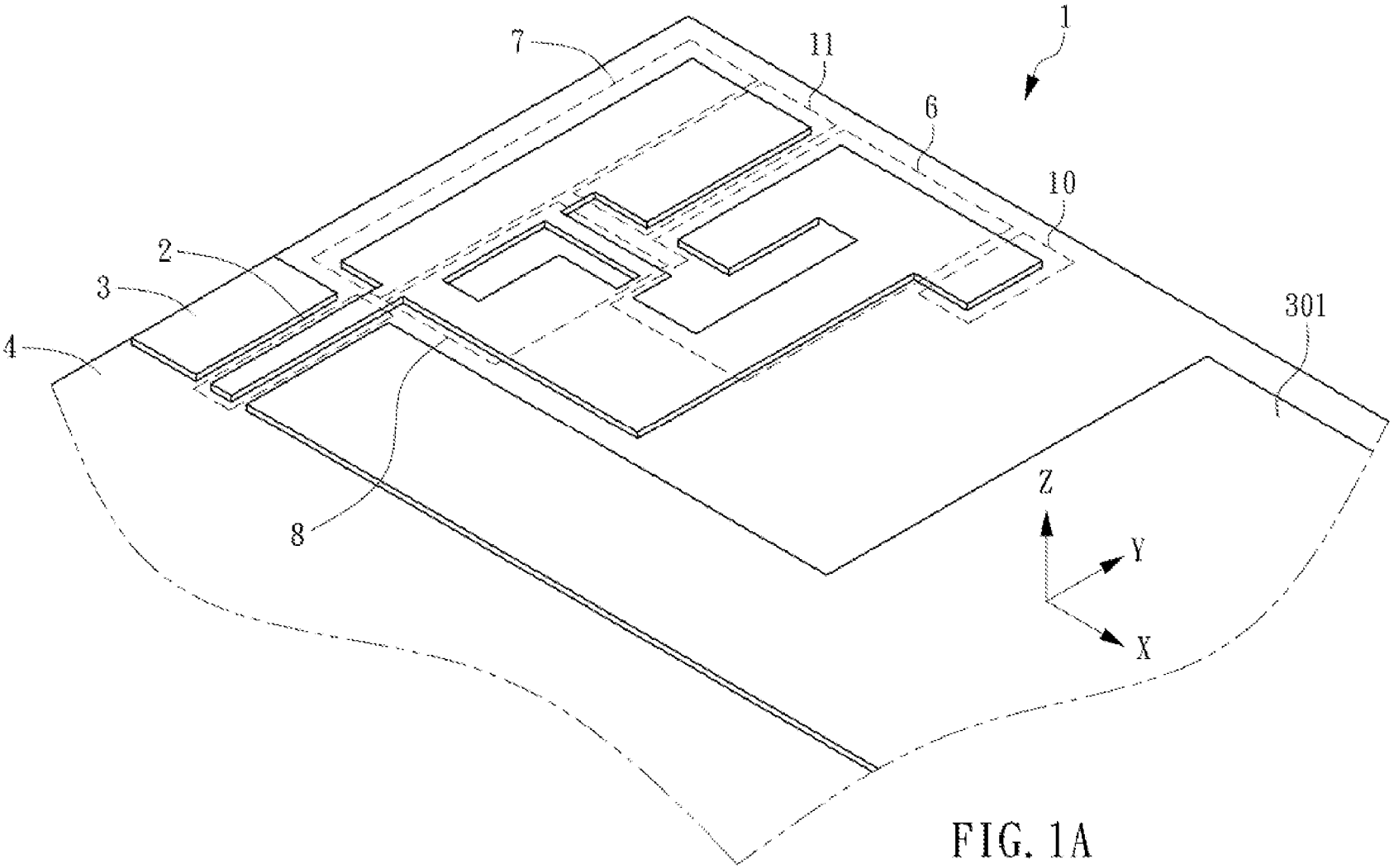
FIG. 1A relates to a top plane view of a preferred embodiment according to the present invention.
Figure 1B:
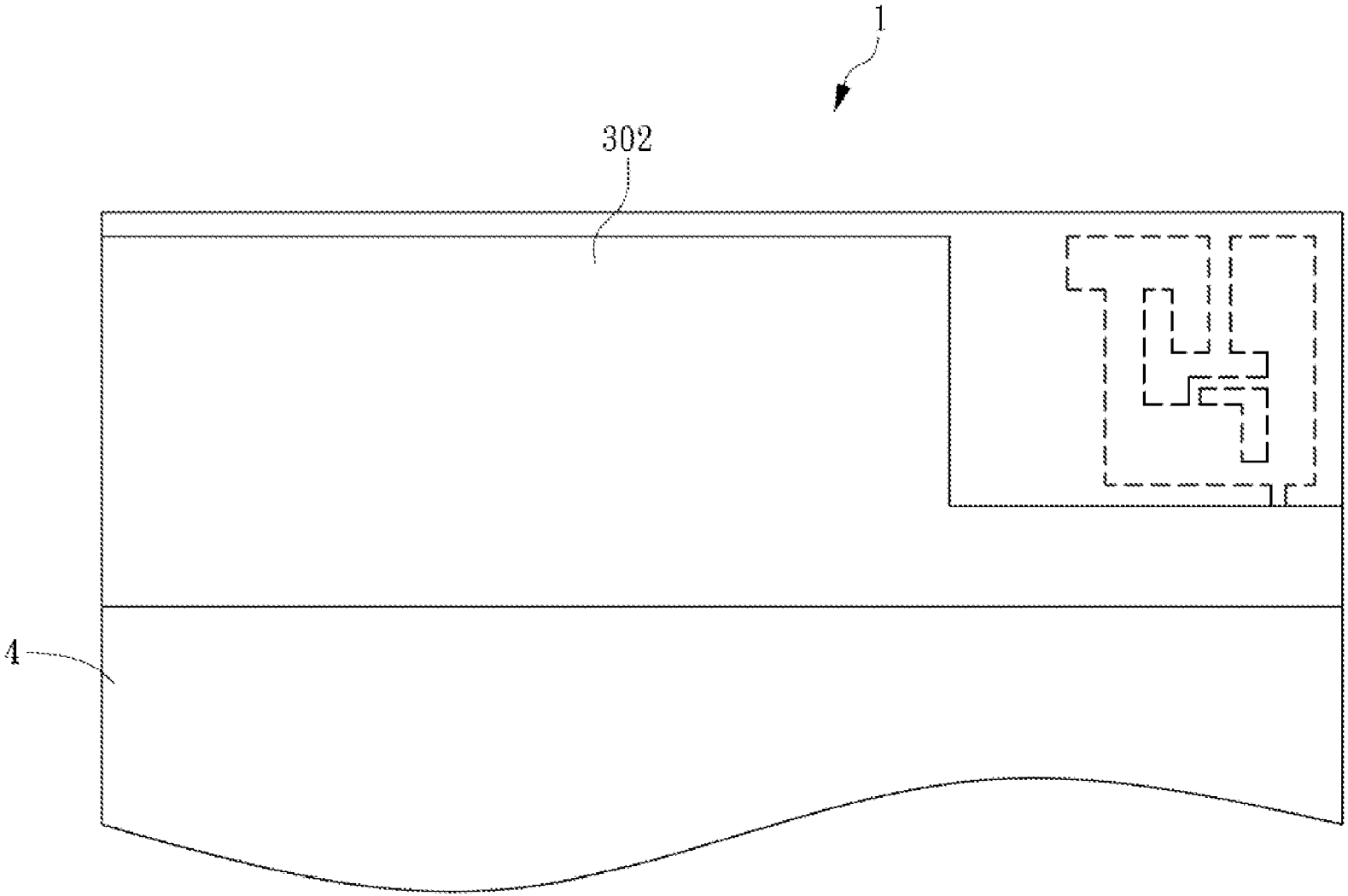
FIG. 1B relates to a bottom plane view of a preferred embodiment according to the present invention.
Figure 1C:
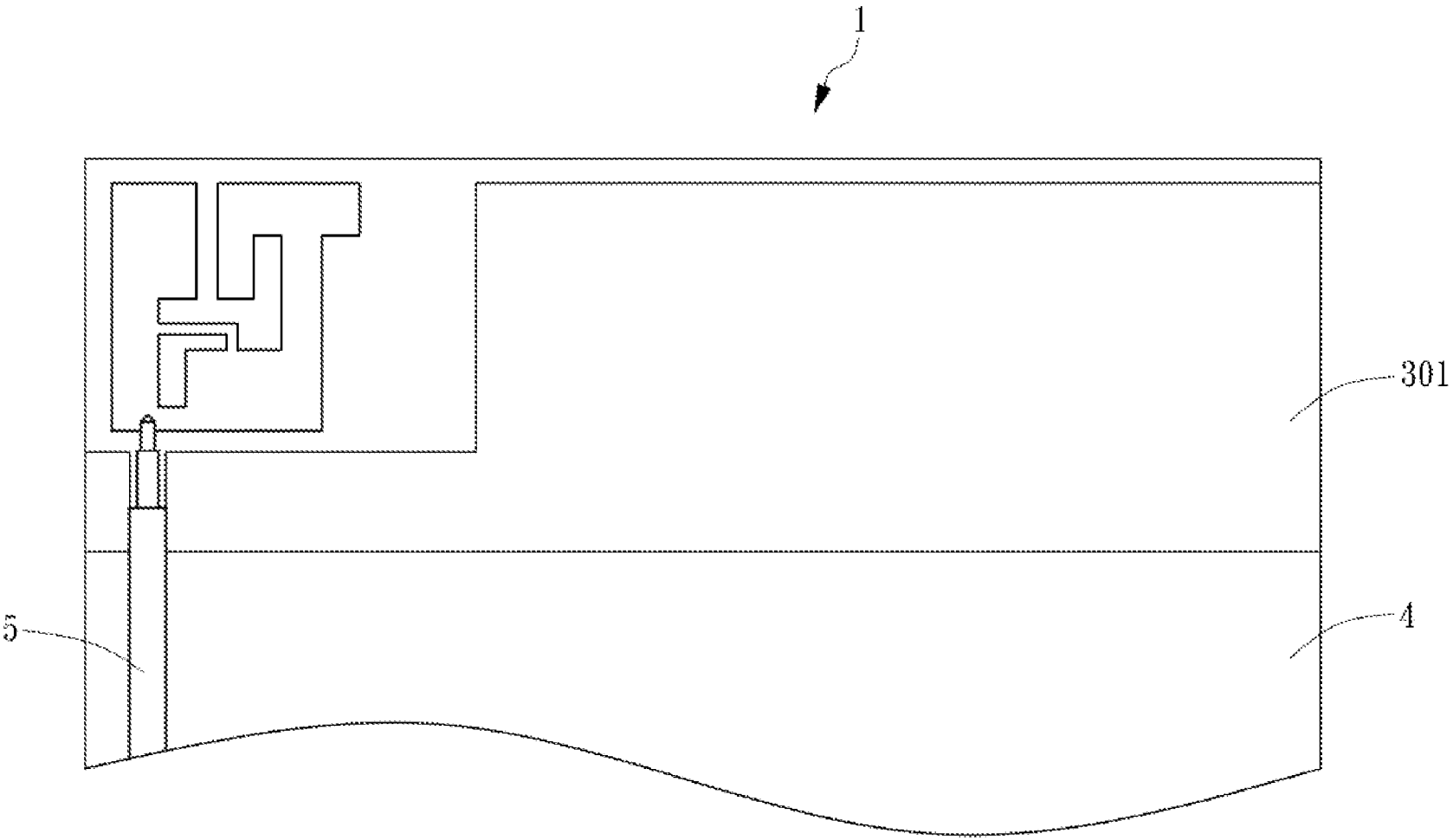
FIG. 1C relates to a top plane view of a preferred embodiment according to the present invention with connected feed-in wire.
Figure 1D:
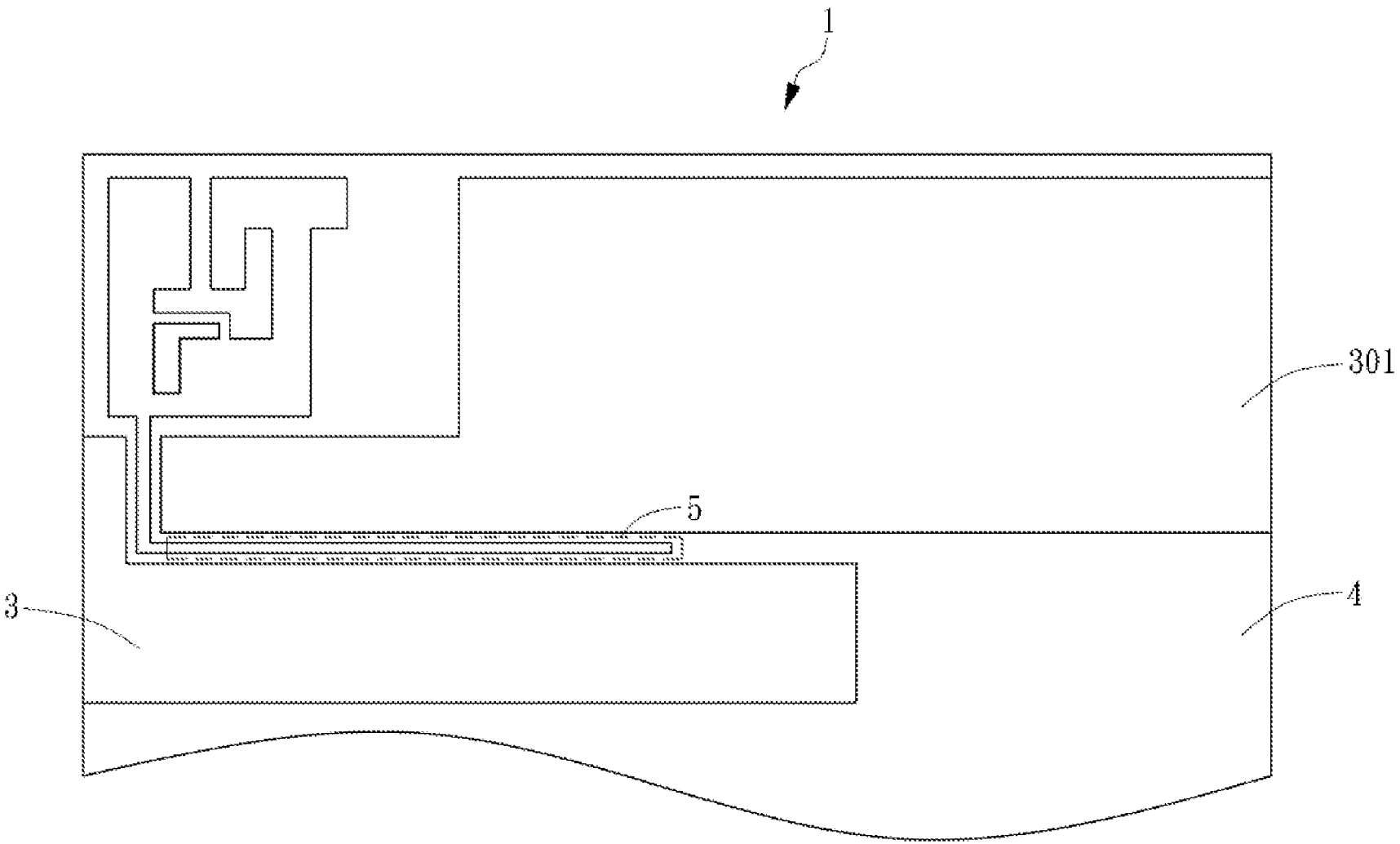
FIG. 1D relates to a top plane view of another one of the preferred embodiments according to the present invention with connected feed-in wire.

The following descriptions are of exemplary embodiments only, and are not intended to limit the scope, applicability, or configuration of the invention in any way.

Rather, the following description provides a convenient illustration for implementing exemplary embodiments of the invention. Various changes to the described embodiments may be made in the function and arrangement of the elements described. For your esteemed members of reviewing committee to further understand and recognize the fulfilled functions and structural characteristics of the invention, several exemplary embodiments cooperating with detailed description are presented as the follows.

FIG. 1A, FIG. 1B, FIG. 1C and FIG. 1D respectively relate to a top plane view and a bottom plane view of the preferred embodiment in the present invention, and a top plane view of the preferred embodiment with the feed-in wire is connected, and a bottom plane view of the preferred embodiment where the feed-in wire is connected. Please refer to FIG. 1A, FIG. 1B, and FIG. 1C at the same time. The present invention relates to a dual-band printed monopole antenna 1, printed on the first face of a substrate 4, wherein said rectangular structure's peripheral consisting of a first edge, a second edge, a third edge, and a fourth edge, said antenna 1 comprises: a first radiating unit 6, being a strip structure and disposed at the inner side of the peripheral, and said strip structure extends to the third edge from the first edge and along the second edge, and said third edge further bends toward the direction of the first edge, by means of adjusting said strip structure's dimension, the operating frequency and bandwidth thereof can be adjusted accordingly, wherein preferably, the length of the first radiating unit 6 is equivalent to one-fourth of co-vibrating wavelength of its operating frequency (For example, 4.9 GHz to 5.875 GHz but not limited thereto); a second radiating unit 7, being of the strip structure and disposed at the inner side of the peripheral, and said strip structure extends to the third edge from the first edge and along the fourth edge, similarly, by means of adjusting the dimension of said strip structure the operating bandwidth and frequency of said second radiating unit 7 can be manipulated, wherein preferably, the length of the first radiating unit 7 is equivalent to one-fourth of co-vibrating wavelength of its operating frequency (For example, 2.4 GHz to 2.5 GHz but not limited thereto); a matching unit 8, being disposed between said first radiating unit 6 and the second radiating unit 7, for enabling the first radiating unit 6 and the second radiating unit 7 electronically connected; by means of adjusting the shape or the size said matching unit 8, the impedance matching of said dual-band antenna can be manipulated so as to ensure said dual-band antenna can achieve a good VSWR (Voltage Standing Wave Ratio) output, wherein said matching unit 8 further comprising a cavity, by means of adjusting the shape or the size of said cavity, the impedance matching of said dual-band antenna can be manipulated, and preferably, said cavity is in "L" shape; a first matching unit 10, being disposed at the first radiating unit 6, and taken shaped at the exterior side of the peripheral of said rectangular structure, by means of adjusting the shape or the size of said first matching unit 10, the impedance matching of said first radiating unit can be manipulated so as to generate a corresponding band signal output, generally speaking, the shape of said first matching unit 10 is preferably a quadrilateral of rectangular; a second matching unit 11, taken shaped at the inner side of the peripheral of said rectangular structure, by means of adjusting the shape or the size the impedance matching of said first radiating unit 7 can be manipulated so as to generate a corresponding band signal output, generally speaking, said second matching unit 11 are preferably shaped in quadrilateral or rectangular; a signal feed-in terminal 2, electronically connected with said second radiating unit 7; and a feed-in signal grounding terminal, comprising a first feed-in signal grounding terminal 3, a second grounding terminal 301, and a third grounding terminal 302, wherein said first feed-in signal grounding terminal 3 and said second grounding terminal 301 are taken shaped at the first face of the substrate 4 and make the signal feed-in terminal 2 be disposed between said first feed-in signal grounding terminal 3 and the second grounding terminal 301, and the third grounding terminal 302 is taken shaped at a second face of the substrate 4, wherein said third grounding terminal 302 is disposed at the second face of the substrate 4 complimentary to said first feed-in signal grounding terminal 3 and said second grounding terminal 301. One skilled in the art can adjust the size and the shape of the first feed-in signal grounding terminal 3, the second grounding terminal 301, and the third grounding terminal 302 based upon the actual demand of the desired product. Generally speaking, in order to achieve a better transmitting/receiving efficiency and a cost reduction, preferably, said first radiating unit 6, said second radiating unit 7, said matching unit 8, said first matching unit 10, said second matching unit 11 and said signal feed-in terminal 2 are made of building-integrated metal structure, and by means of adjusting the size and the shape of said first feed-in signal grounding terminal 3, said second grounding terminal 301, and said third grounding terminal 302, the return loss of the antenna can be reduced and the gain of the same can be enhanced. For the purpose of better transmission for the antenna signals, preferably, a feed-in wire 5 are further coupled to said signal feed-in terminal 2. In one of the preferred embodiments, said feed-in wire 5 is made of a micro strip (as suggested in FIG. 1D), wherein the input impedance of said micro strip is preferably 50 Ohms And in another one of the preferred embodiments, said feed-in wire is made of a signal feed-in cable (as suggested in FIG. 1C). And the foregoing said antenna 1 is disposed at one of the corners of the substrate, meanwhile, said antenna 1 can also be disposed at the substrate in pair, and preferably said antenna 1 disposed on the substrate in pair can be disposed at two complementary corners on said substrate 4, wherein said first radiating unit 6, said second radiating unit 7, said matching unit 8, sand first matching unit 10, said second matching unit 11, said signal feed-in terminal 2 and said first feed-in signal grounding terminal are complementarily disposed, and said second grounding terminal 301 and said third grounding terminal 302 are commonly-shared disposed. One skilled in the ordinary art can easily understand the foregoing structure and installation, thus additional information will be omitted.

Figure 1E:
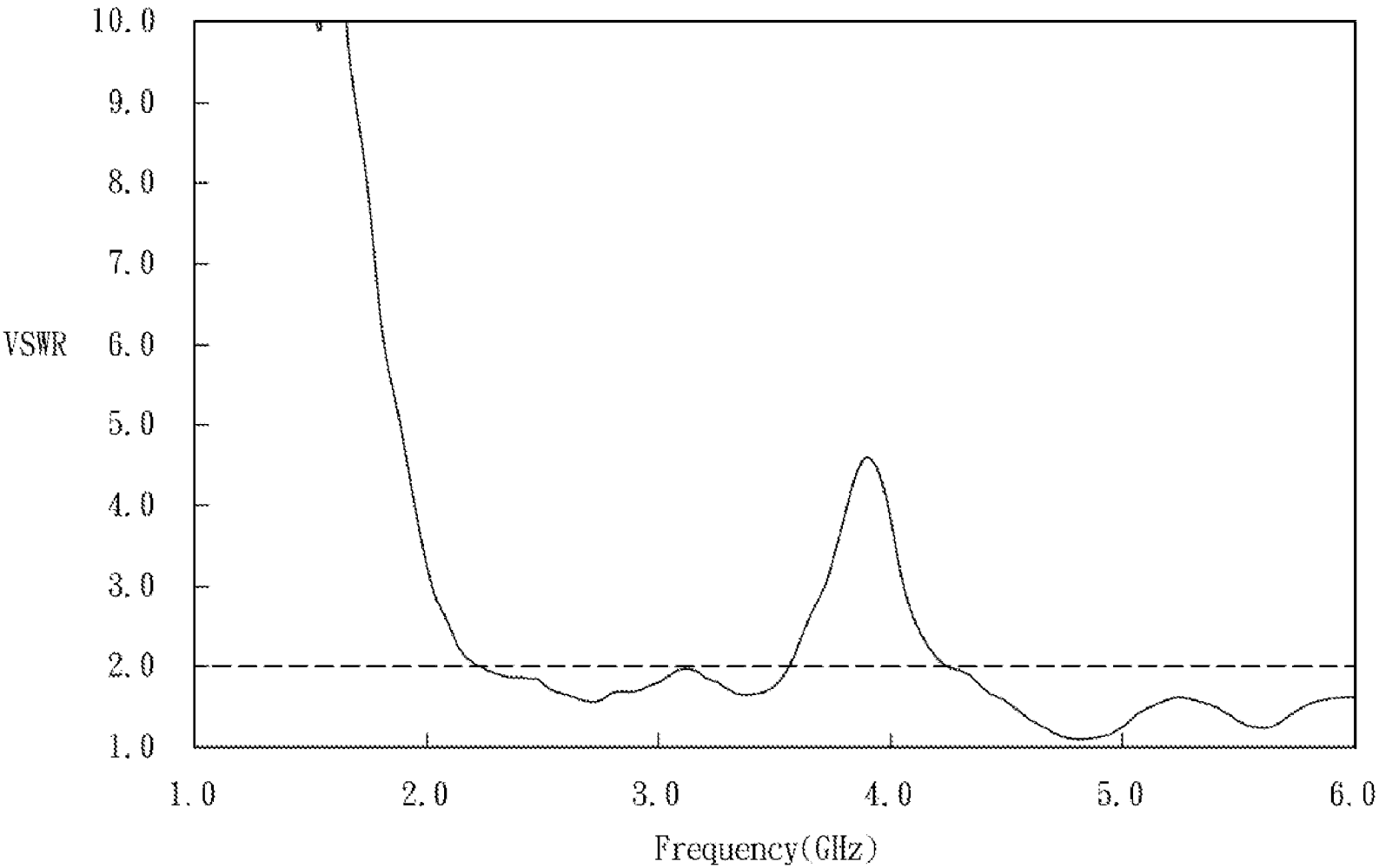
FIG. 1E relates to a measurement plot regarding to the frequency vs. VSWR according to the preferred embodiment of the aforesaid present invention.

Please refer to FIG. 1E, which relates to a measurement plot regarding to the frequency vs. VSWR according to the preferred embodiment of the aforesaid present invention. When VSWR is used for the calibration reference of the signal feed-in terminal 2, from the actual measurement, the dual-band printed monopole antenna 1 is characterized in good signal transmission capability in its corresponding dual-band operating band. More importantly, the dual-band printed monopole antenna 1 in the present invention is smaller and more delicate than the conventional dual-band printed monopole antenna.

Figure 1F:
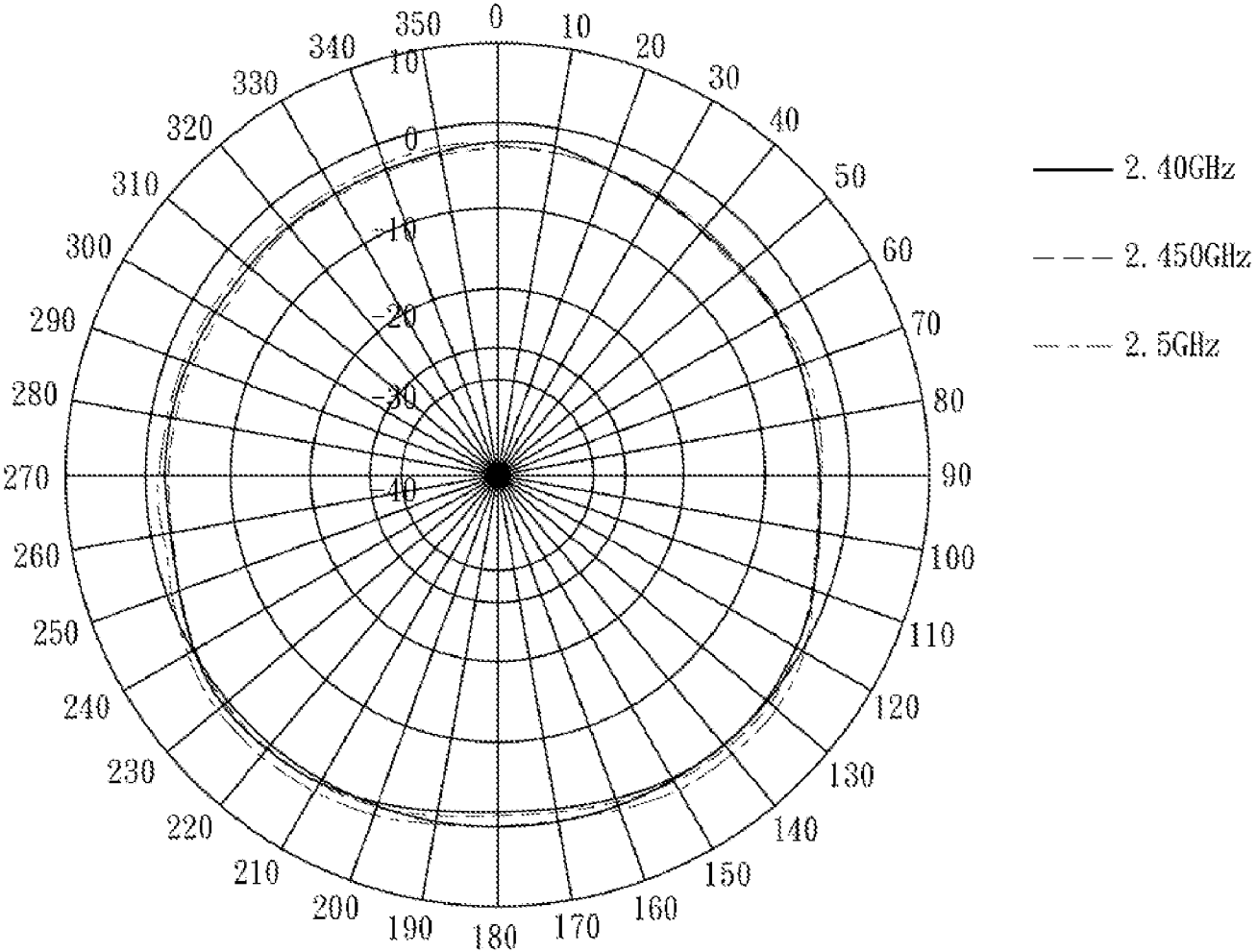
FIG. 1F relates to an antenna field plot measured at the Y-Z plane based upon the description of FIG. 1A.
Figure 1G:
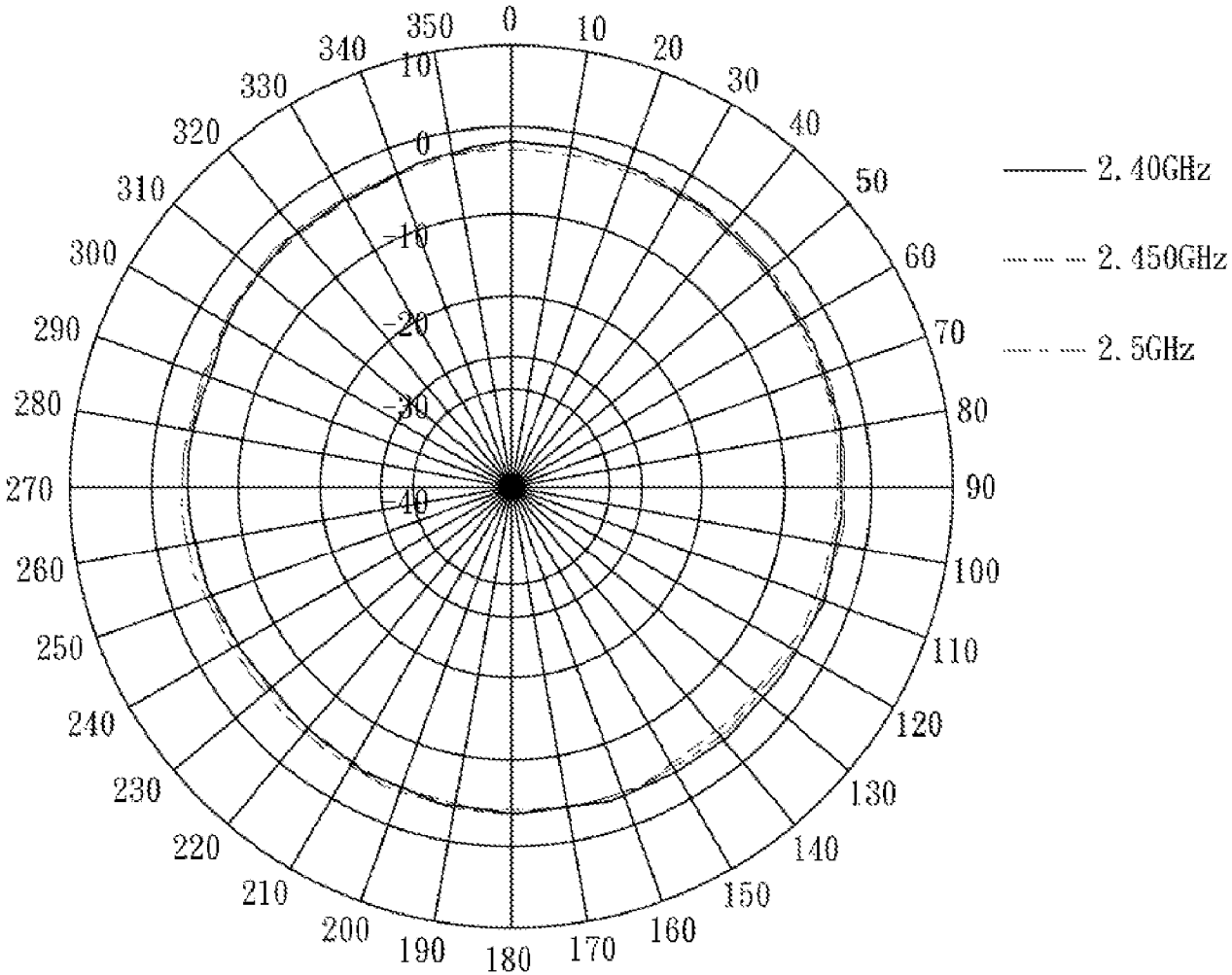
FIG. 1G relates to an antenna field plot measured at the Z-X plane based upon the description of FIG. 1A.
Figure 1H:
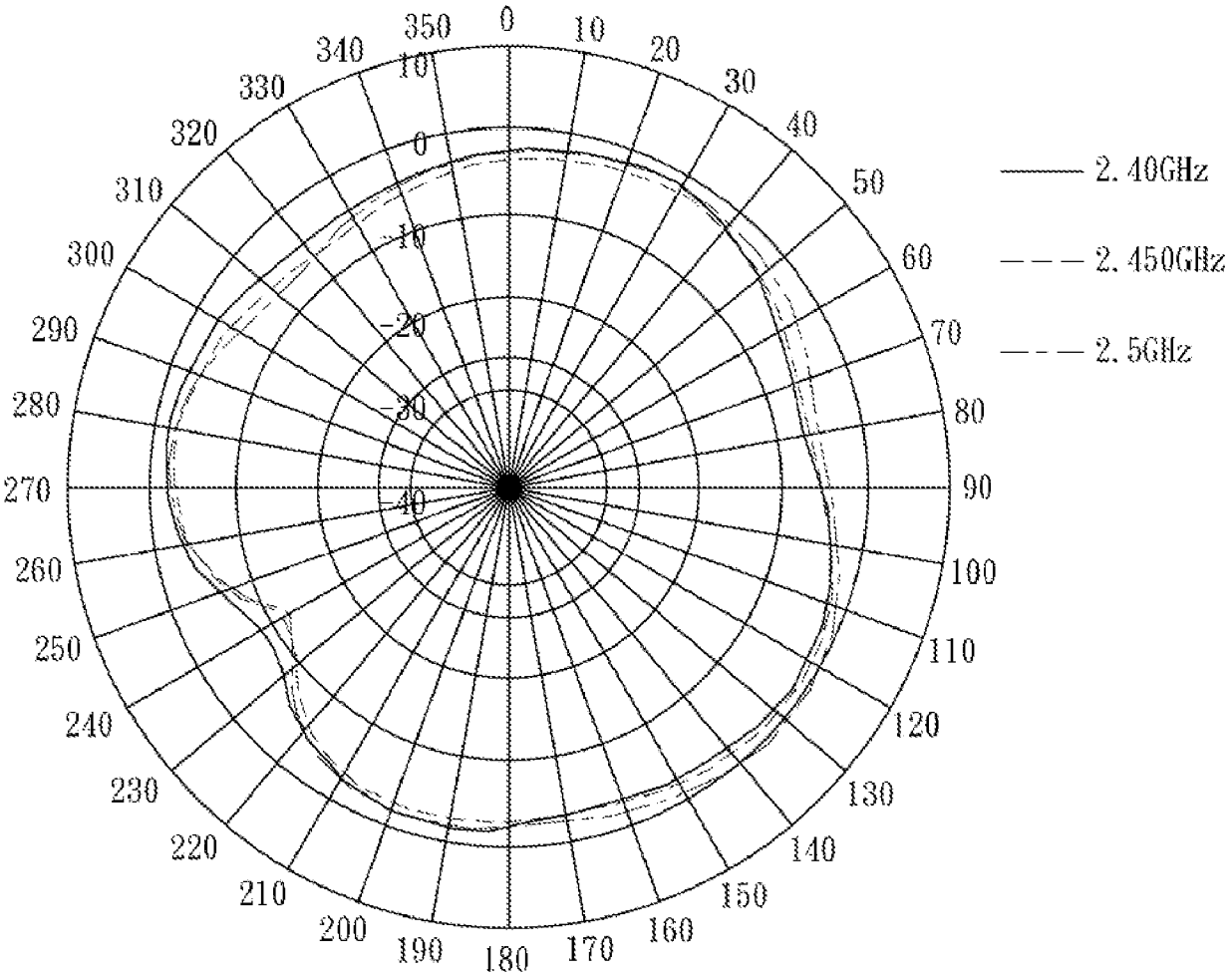
FIG. 1H relates to an antenna field plot measured at the X-Y plane based upon the description of FIG. 1A.
Figure 11:
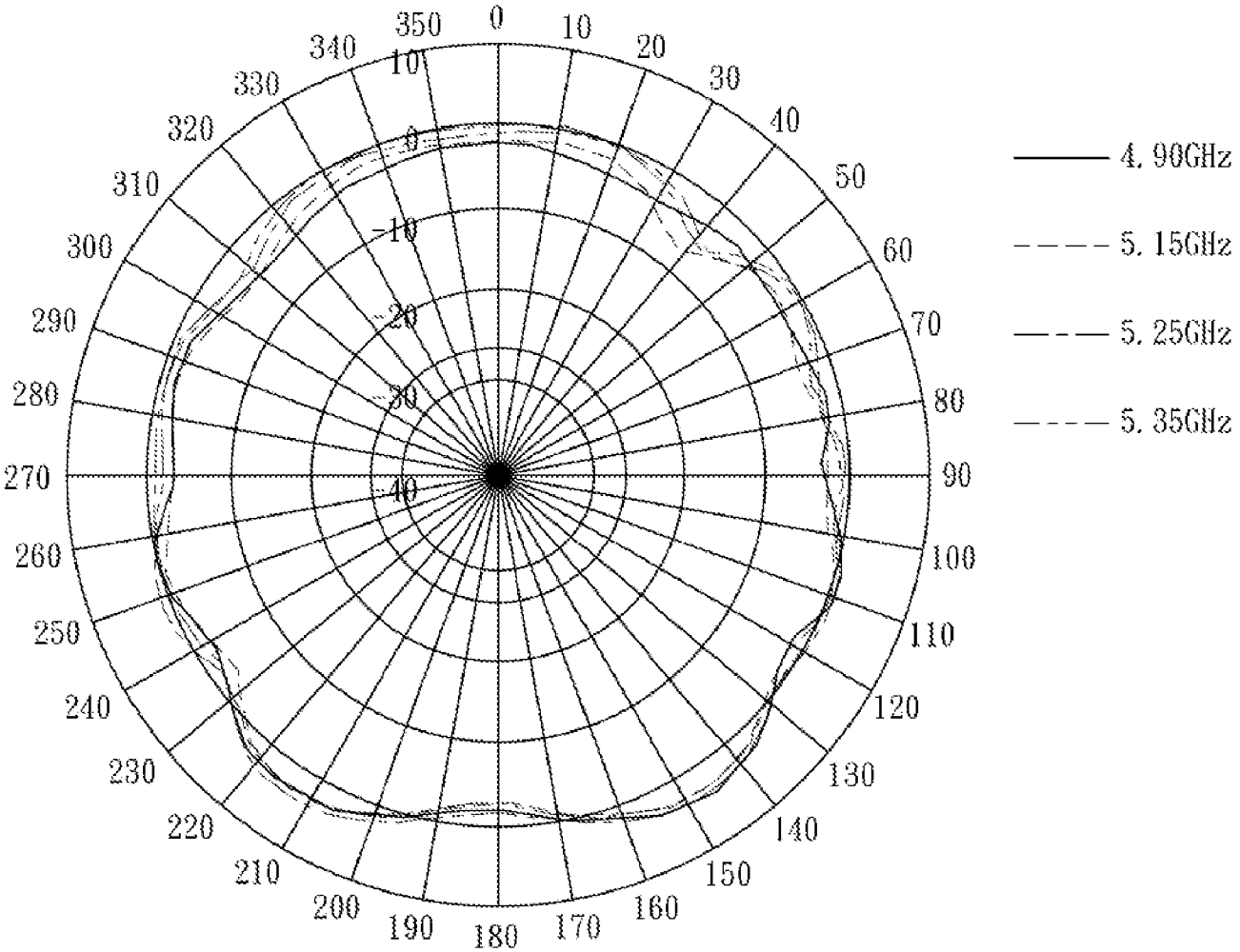

FIG. 1F to FIG. 1H relate to an antenna field plot measured at the Y-Z plane, Z-X plane, and X-Y plane based upon the description of FIG. 1A. The band between 2.4 GHz to 2.5 GHz is measured respectively. As illustrated in FIG. 1F to FIG. 1H, in the aforementioned band, the dual-band printed monopole antenna 1 in the present invention is indeed advantageous at good signal transmission effect in each plane and in each direction.

Figure 1J:
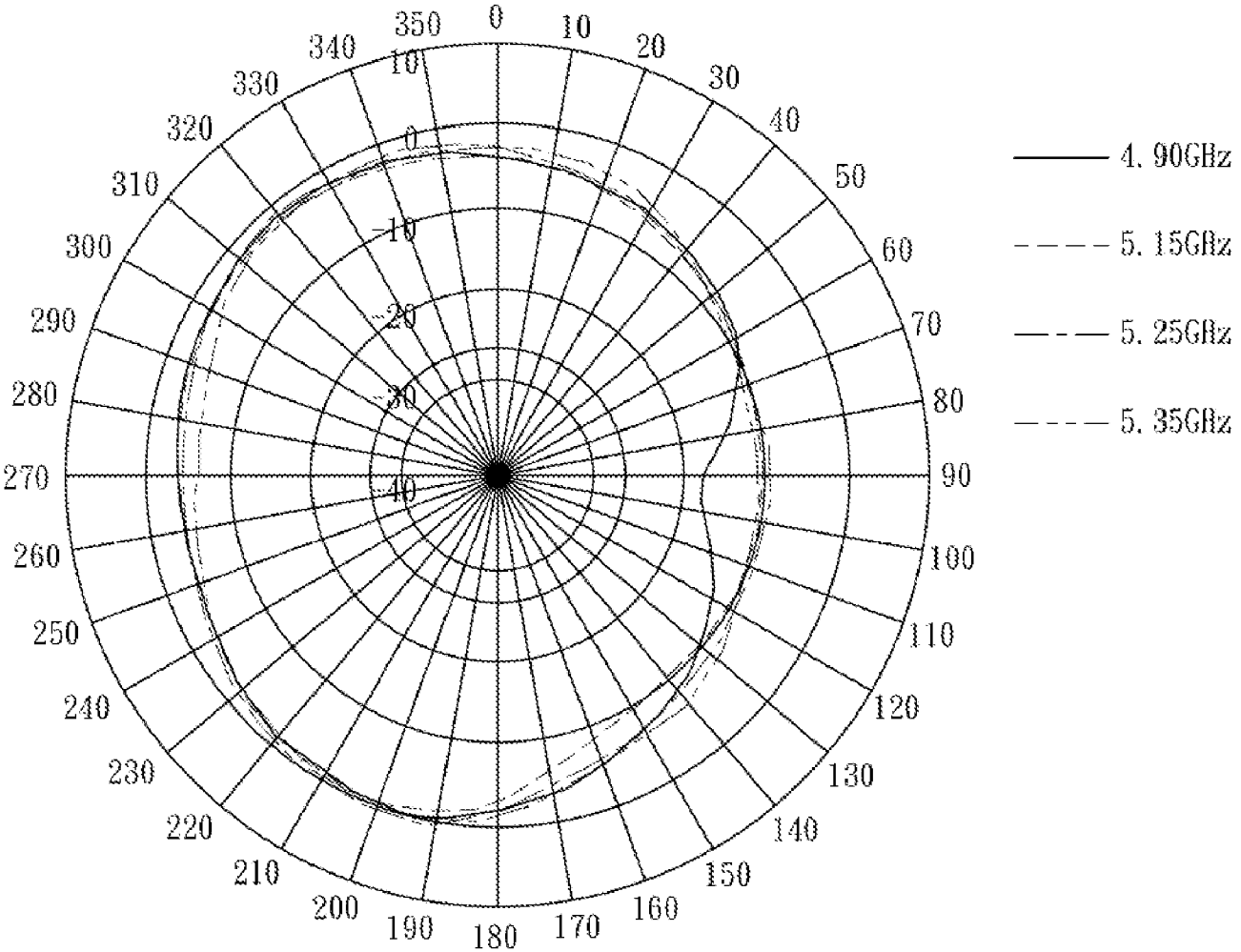
FIG. 1J relates to an antenna field plot measured at the Z-X plane based upon the description of FIG. 1A.
Figure 1K:
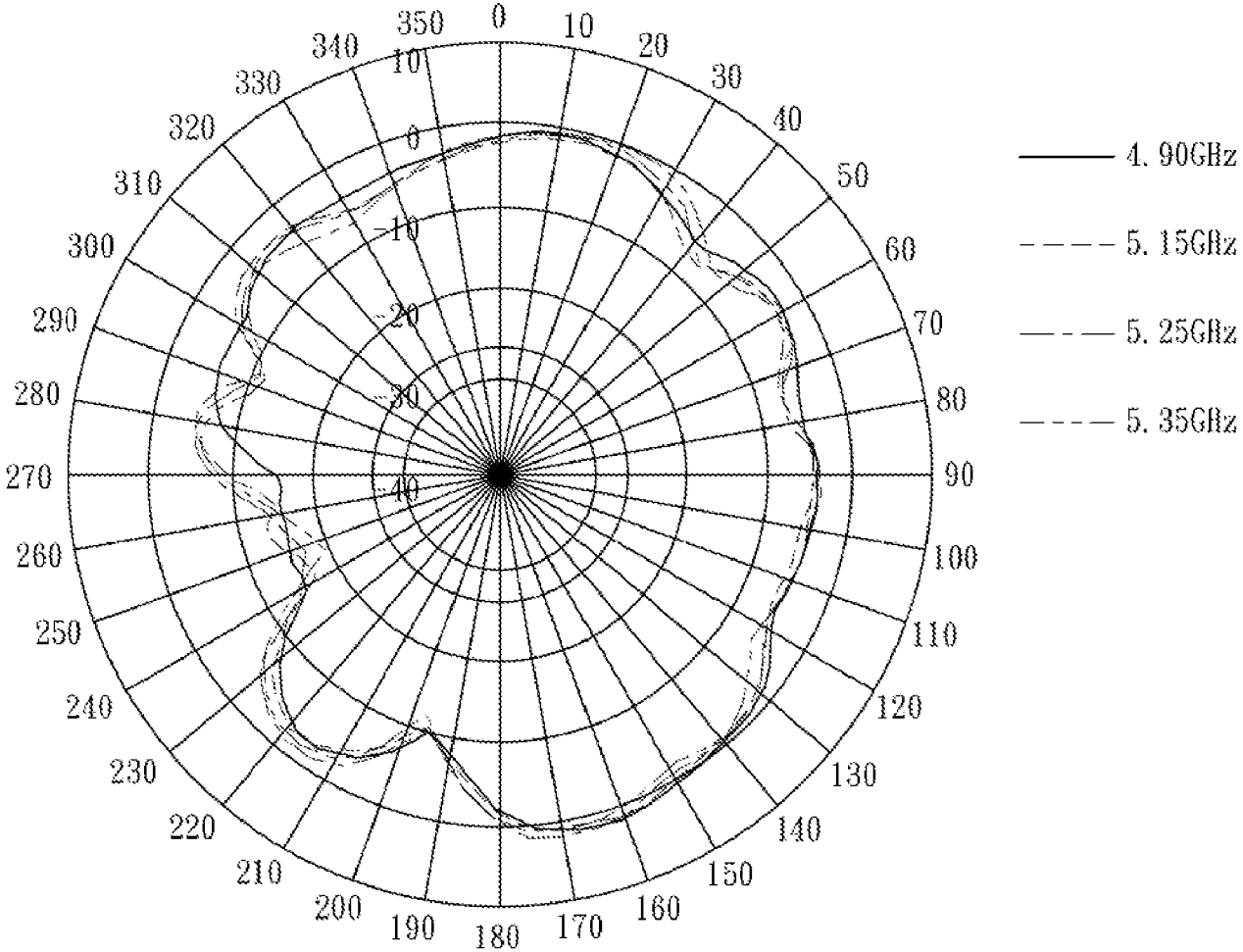
FIG. 1K relates to an antenna field plot measured at the X-Y plane based upon the description of FIG. 1A.

FIG. 1I to FIG. 1K relate to an antenna field plot measured at the Y-Z plane, Z-X plane, and X-Y plane based upon the description of FIG. 1A. The band between 4.9 GHz to 5.35 GHz is measured respectively. As illustrated in FIG. 1I to FIG. 1K, in the aforementioned band, the dual-band printed monopole antenna 1 in the present invention is indeed advantageous at good signal transmission effect in each plane and in each direction.

Figure 1L:
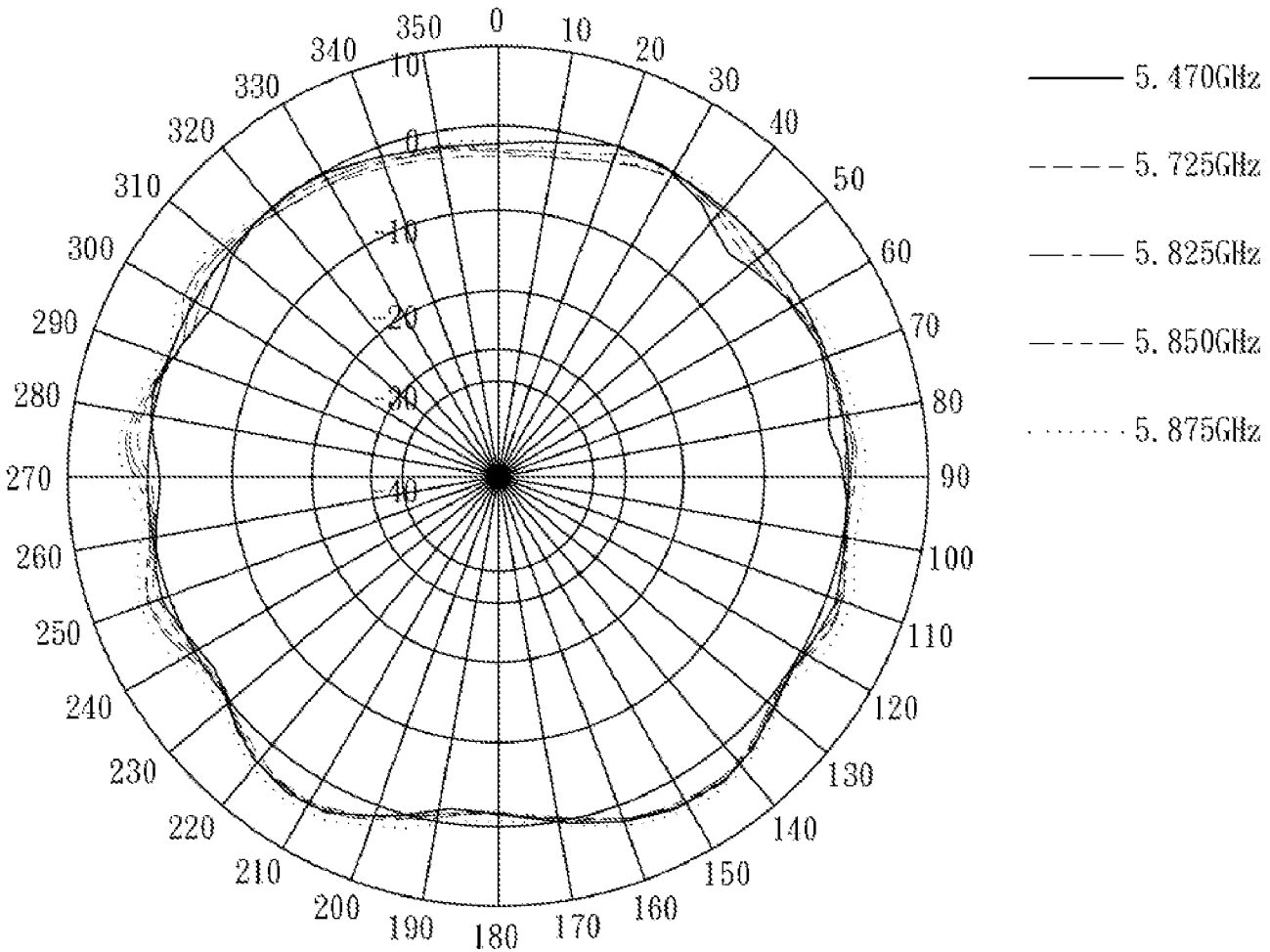
FIG. 1L relates to an antenna field plot measured at the Y-Z plane based upon the description of FIG. 1A.
Figure 1M:
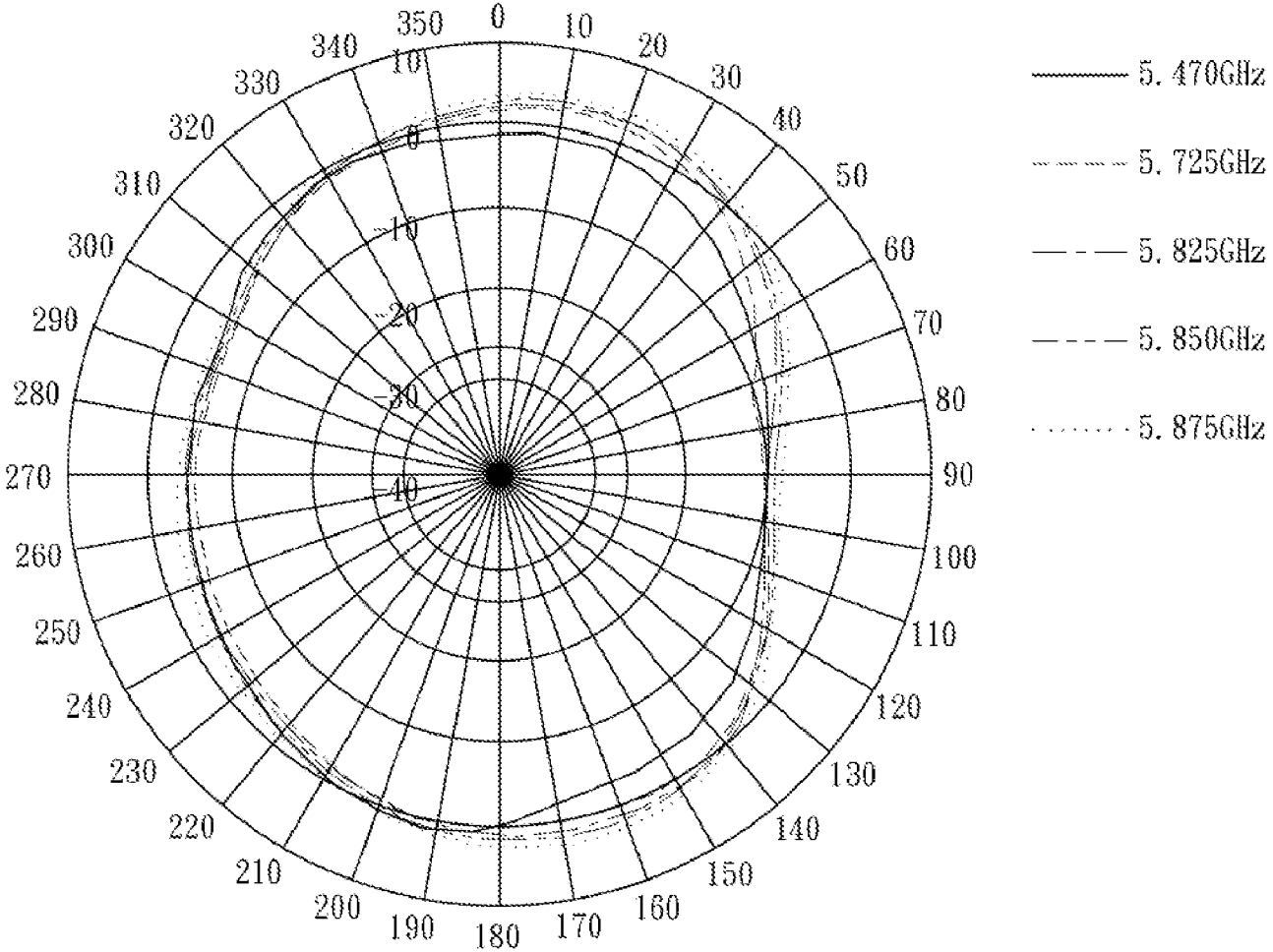
FIG. 1M relates to an antenna field plot measured at the Z-X plane based upon the description of FIG. 1A.
Figure 1N:
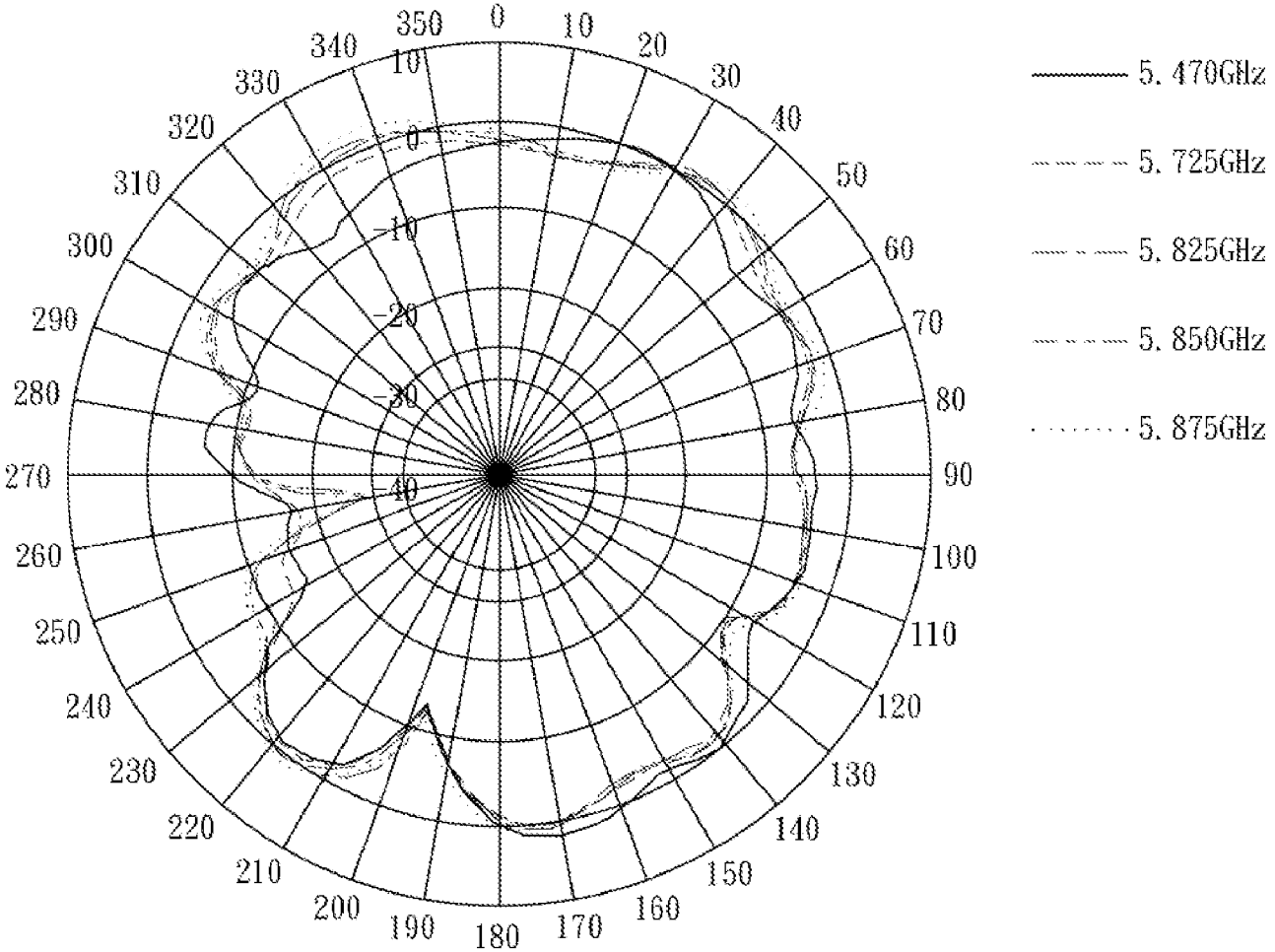
FIG. 1N relates to an antenna field plot measured at the X-Y plane based upon the description of FIG. 1A.

FIG. 1L to FIG. 1N relate to an antenna field plot measured at the Y-Z plane, Z-X plane, and X-Y plane based upon the description of FIG. 1A. The band between 5.47 GHz to 5.875 GHz is measured respectively. As illustrated in FIG. 1L to FIG. 1N, in the aforementioned band, the dual-band printed monopole antenna 1 in the present invention is indeed advantageous at good signal transmission effect in each plane and in each direction.

Figure 2A:
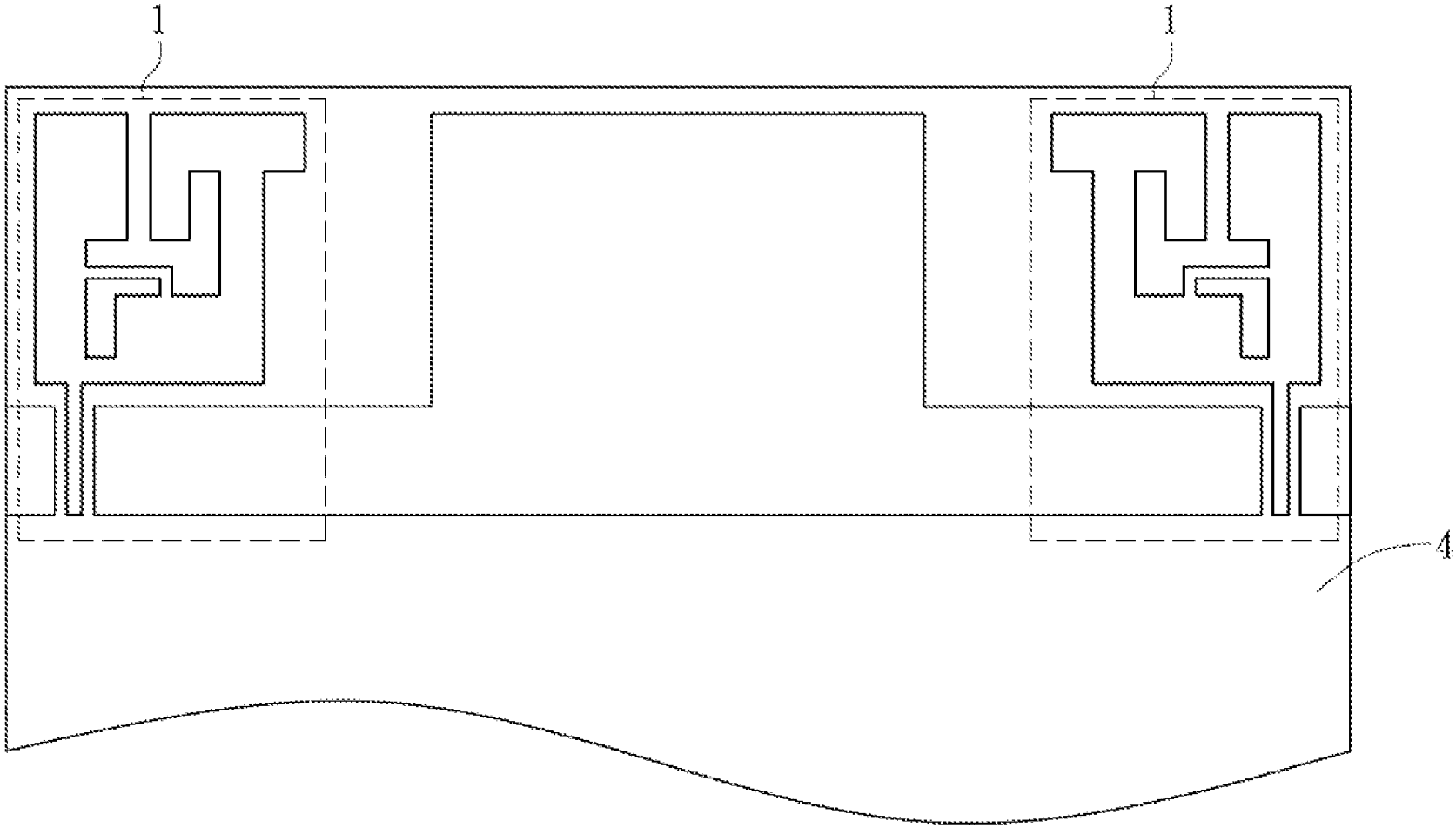
FIG. 2A respectively relates to the top plane view of the preferred embodiments in the present invention for which two dual-band printed monopole antennas 1 are used.
Figure 2B:
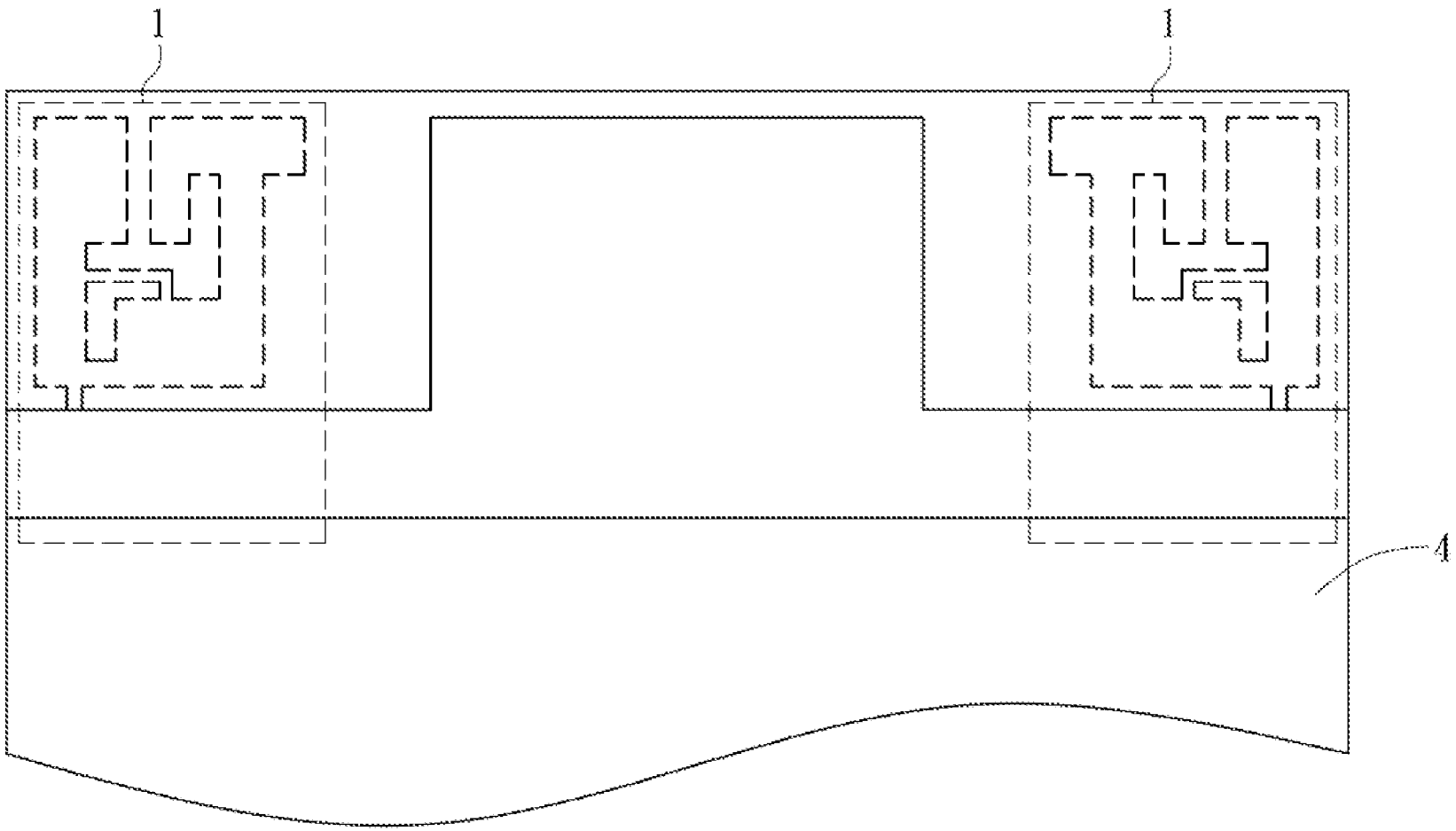
FIG. 2B respectively relates to the bottom plane view of the preferred embodiments in the present invention for which two dual-band printed monopole antennas 1 are used.

FIG. 2A and FIG. 2B respectively relate to the top plane view and the bottom plane view of the preferred embodiments in the present invention for which two dual-band printed monopole antennas 1 are used. Please simultaneously refer to FIG. 2A and FIG. 2B together with FIG. 1A and FIG. 1B, in order to improve the transmission capability for said antenna, one skilled in the art can also disposed said antennas 1 at the substrate 4. Generally speaking, two dual-band printed monopole antennas 1 are, preferably, disposed complimentarily so as to achieve the goal of the best transmission.

Figure 3:
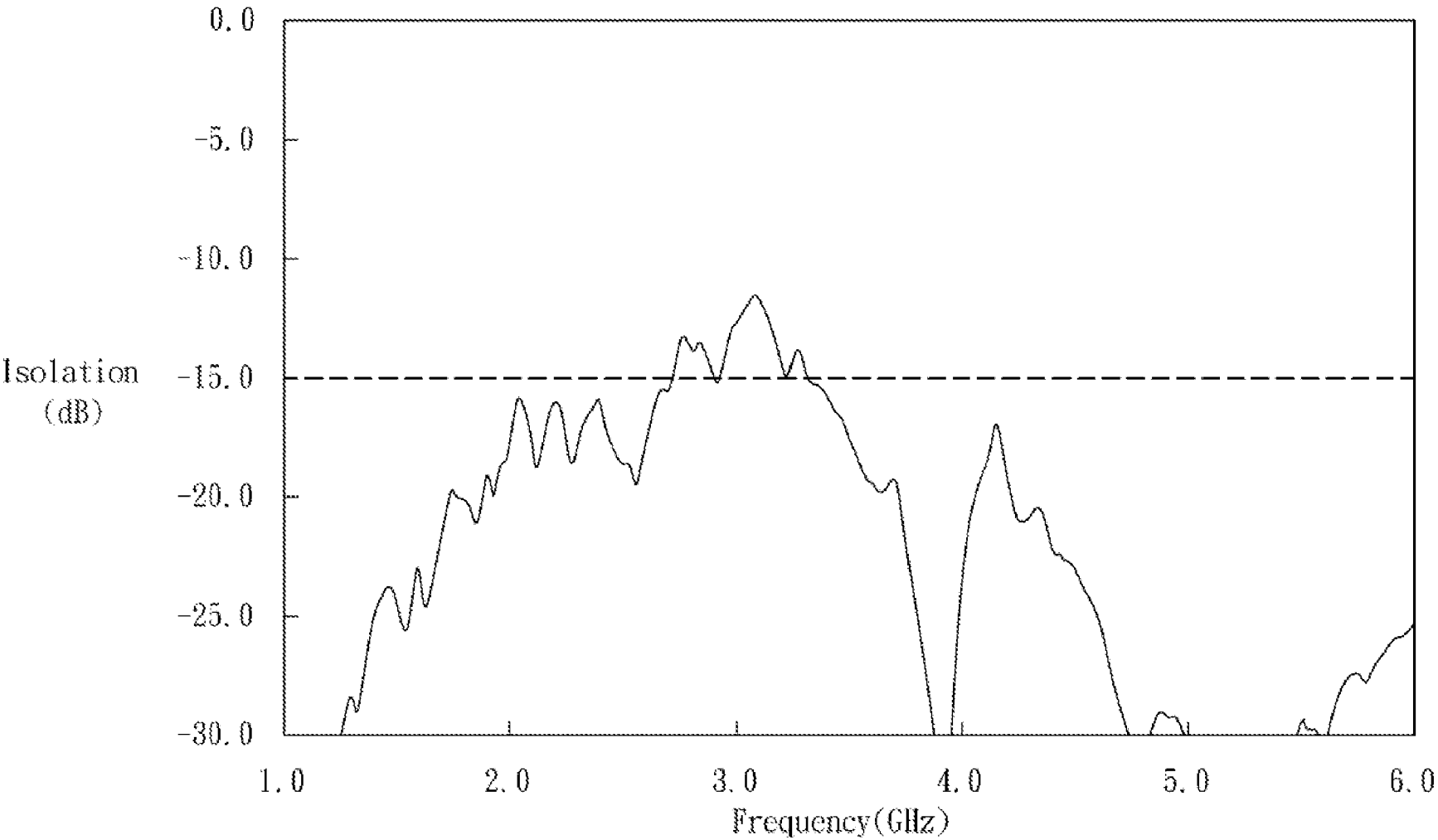
FIG. 3 relates to the isolation test result measurement plot for the two antennas according to the aforesaid present invention.

FIG. 3 relates to the isolation test result measurement plot for the two antennas according to the aforesaid present invention. Please further refer to FIG. 4, while −15 dB is used for the calibration reference, in the actual measurement, the dual-band printed monopole antenna 1 in the present invention is again proved there is effective isolation with superior signal transmission capability.

From the foregoing disclosure, one skilled in the art can apparently understand, the present invention discloses a dual-band printed monopole antenna can be minimized in its size so as to meet the demand for daily-minimized wireless electronic devices.

The invention being thus aforesaid, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A dual-band printed monopole antenna, printed on the first face of a substrate in a rectangular structure, wherein said rectangular structure's peripheral consisting of a first edge, a second edge, a third edge and a fourth edge, said antenna comprising:

a first radiating unit, being of a strip structure and disposed at the inner side of the peripheral, and said strip structure extending to the third edge from the first edge and along the second edge, and said strip structure from said third edge further bending toward the direction of the first edge;

a second radiating unit, being of the strip structure and disposed at the inner side of the peripheral, and said strip structure extending to the third edge from the first edge and along the fourth edge;

a matching unit, being disposed between the first radiating unit and the second radiating unit, for enabling the first radiating unit and the second radiating unit electronically connected;

a first matching unit, being disposed at the first radiating unit, and taken shaped at the exterior side of the peripheral of said rectangular structure;

a second matching unit, being disposed at the first radiating unit, and taken shaped at the inner side of the peripheral of said rectangular structure;

a signal feed-in terminal, electronically connected with said second radiating unit; and a feed-in signal grounding terminal, comprising a first feed-in signal grounding terminal, a second grounding terminal, and a third grounding terminal, wherein said first feed-in signal grounding terminal and said second grounding terminal are taken shaped at the first face of the substrate and make the signal feed-in terminal being disposed between said first feed-in signal grounding terminal and the second grounding terminal, and said third grounding terminal is taken shaped at a second face of the substrate.

2. The dual-band printed monopole antenna of claim 1, wherein said first radiating unit, said second radiating unit, said matching unit, said first matching unit, said second matching unit, and said signal feed-in terminal are of building-integrated metal structure.

3. The dual-band printed monopole antenna of claim 1, wherein said third grounding terminal is disposed at the second face of the substrate complimentary to said first feed-in signal grounding terminal and said second grounding terminal.

4. The dual-band printed monopole antenna of claim 1, further comprising a feed-in wire coupled to said signal feed-in terminal.

5. The dual-band printed monopole antenna of claim 4, wherein said feed-in wire is selected from the group of a micro strip and a signal feed-in cable.

6. The dual-band printed monopole antenna of claim 1, wherein the length of the first radiating unit or the second radiating unit is equivalent to one-fourth co-vibrating wavelength of its operating frequency.

7. The dual-band printed monopole antenna of claim 1, wherein the first radiating unit is operating in a first operating frequency, and the second radiating unit is operating in a second operating frequency, and said first operating frequency is smaller than the second operating frequency.

8. The dual-band printed monopole antenna of claim 1, wherein said first radiating unit is operating within the range between 4.9 GHz and 5.875 GHz, and said second radiating unit is operating within the range between 2.4 GHz and 2.5 GHz.

9. The dual-band printed monopole antenna of claim 1, wherein said matching unit further comprises a cavity, and its size is changed so as to adjust the antenna impedance matching of said first radiating unit and said second radiating unit.

10. The dual-band printed monopole antenna of claim 9, wherein said cavity's shape is "L" shaped.

11. The dual-band printed monopole antenna of claim 1, wherein said first matching unit or said second matching unit is in the shape of quadrilateral or rectangular.

12. The dual-band printed monopole antenna of claim 1, wherein said dual-band printed monopole antenna is disposed at one of the corners of the substrate.

13. The dual-band printed monopole antenna of claim 1, wherein said dual-band printed monopole antenna is disposed at the substrate in pair.

14. The dual-band printed monopole antenna of claim 13, wherein said first radiating unit, said second radiating unit, said matching unit, said first matching unit, said second matching unit, said signal feed-in terminal and said first feed-in signal grounding terminal are complimentary disposed, said second grounding terminal and said third grounding terminal are commonly-shared disposed.

15. The dual-band printed monopole antenna of claim 13, wherein said pair of dual-band printed monopole antennas are disposed at the two complimentary corners of the substrate.

16. A dual-band printed monopole antenna, printed on the first face of a substrate in a rectangular structure, wherein said rectangular structure's peripheral consisting of a first edge, a second edge, a third edge and a fourth edge, said antenna comprising:

a first radiating unit, being of a strip structure and disposed at the inner side of the peripheral, and said strip structure extending to the third edge from the first edge and along the second edge, and said strip structure from said third edge further bending toward the direction of the first edge;

a second radiating unit, being of the strip structure and disposed at the inner side of the peripheral, and said strip structure extending to the third edge from the first edge and along the fourth edge;

a first matching unit, being disposed between the first radiating unit and the second radiating unit, for enabling the first radiating unit and the second radiating unit electronically connected;

a signal feed-in terminal, electronically connected with said second radiating unit; and a feed-in signal grounding terminal, adjacently disposed at the first face of the substrate with said signal feed-in terminal.

17. The dual-band printed monopole antenna of claim 16, wherein said first radiating unit, said second radiating unit, said first matching unit, and said signal feed-in terminal are of building-integrated metal structure.

18. The dual-band printed monopole antenna of claim 16, further comprising a second matching unit, disposed at said first radiating unit, and taken shaped at the exterior side of said rectangular structure.

19. The dual-band printed monopole antenna of claim 18, wherein said first matching unit or said second matching unit is in the shape of quadrilateral or rectangular.

20. The dual-band printed monopole antenna of claim 16, further comprising a second matching unit, disposed at said second radiating unit, and taken shaped at the interior side of said rectangular structure.

21. The dual-band printed monopole antenna of claim 20, wherein said first matching unit or said second matching unit is in the shape of quadrilateral or rectangular.

22. The dual-band printed monopole antenna of claim 16, wherein said feed-in signal grounding terminal further comprises a first feed-in signal grounding terminal and a second grounding terminal, wherein said first feed-in signal grounding terminal and said second grounding terminal are taken shaped at the first face of the substrate and make the signal feed-in terminal being disposed between said first feed-in signal grounding terminal and the second grounding terminal.

23. The dual-band printed monopole antenna of claim 16, wherein said feed-in signal grounding terminal further comprises a first feed-in signal grounding terminal and a third grounding terminal, wherein said first feed-in signal grounding terminal and said signal feed-in terminal are adjacently disposed at the first face of said substrate, and said third grounding terminal is taken shaped at the second face of said substrate, and said third grounding terminal is taken shaped at the location of the second face of the substrate is complimentary to said first feed-in signal grounding terminal.

24. The dual-band printed monopole antenna of claim 16, wherein said feed-in signal grounding terminal further comprises a first feed-in signal grounding terminal, a second grounding terminal and a third grounding terminal, wherein said first feed-in signal grounding terminal and said second grounding terminal are taken shaped at the first face of the substrate and make the signal feed-in terminal being disposed between said first feed-in signal grounding terminal and the second grounding terminal, and said third grounding terminal is taken shaped at a second face of the substrate, and said third grounding terminal is taken shaped at the location of the second face of the substrate and is complimentary to said first feed-in signal grounding terminal and said second grounding terminal.

25. The dual-band printed monopole antenna of claim 16, wherein the length of the first radiating unit or the second radiating unit is equivalent to one-fourth co-vibrating wavelength of its operating frequency.

26. The dual-band printed monopole antenna of claim 16, wherein the first radiating unit is operating in a first operating frequency, and the second radiating unit is operating in a second operating frequency, and said first operating frequency is smaller than the second operating frequency.

27. The dual-band printed monopole antenna of claim 16, wherein said first matching unit further comprises a cavity, and its size is changed so as to adjust the antenna impedance matching of said first radiating unit and said second radiating unit.

28. The dual-band printed monopole antenna of claim 27, wherein said cavity's shape is "L" shaped.

29. The dual-band printed monopole antenna of claim 16, wherein said dual-band printed monopole antenna is disposed at one of the corners of the substrate.

* * * * *

UNITED STATES PATENT AND TRADEMARK OFFICE

CERTIFICATE OF CORRECTION

PATENT NO. : 8,223,076 B2
APPLICATION NO. : 12/645785
DATED : July 17, 2012
INVENTOR(S) : Chih-Yung Huang It is certified that error appears in the above-identified patent and that said Letters Patent is hereby corrected as shown below:

TITLE PAGE:

ITEM 73 SHOULD READ -- ARCADYAN TECHNOLOGY CORPORATION --

Signed and Sealed this
Eighteenth Day of September, 2012

David J. Kappos

David J. Kappos
*Director of the United States Patent and Trademark Office*